US012808175B2

(12) United States Patent
Yang et al.

(10) Patent No.: US 12,808,175 B2
(45) Date of Patent: Nov. 24, 2026

(54) MOUNTING COMPONENT FOR TOILET

(71) Applicant: Globe Union Industrial Corp., Taichung City (TW)

(72) Inventors: Chao-Ta Yang, Taichung City (TW); Hsin-Jen Wang, Taichung City (TW)

(73) Assignee: GLOBE UNION INDUSTRIAL CORP., Taichung City (TW)

( * ) Notice: Subject to any disclaimer, the term of this patent is extended or adjusted under 35 U.S.C. 154(b) by 48 days.

(21) Appl. No.: 19/079,470

(22) Filed: Mar. 14, 2025

(65) Prior Publication Data

US 2025/0320710 A1 Oct. 16, 2025

(30) Foreign Application Priority Data

Apr. 12, 2024 (CN) ..... 202420761167.9

(51) Int. Cl.
*E03D 11/16* (2006.01)

(52) U.S. Cl.
CPC ..... *E03D 11/16* (2013.01)

(58) Field of Classification Search
CPC ..... E03D 11/16
USPC ..... 4/252.1
See application file for complete search history.

(56) References Cited

U.S. PATENT DOCUMENTS

| | | | | |
|---|---|---|---|---|
| 5,421,036 | A | 6/1995 | Stevens et al. | |
| 6,065,160 | A | 5/2000 | Winn | |
| 6,634,034 | B2 | 10/2003 | Rendell | |
| 8,281,421 | B2 | 10/2012 | Hughes | |
| 9,234,340 | B2 * | 1/2016 | Hong | E03D 11/16 |
| 9,359,754 | B2 * | 6/2016 | Zhou | E03D 11/16 |
| 2012/0291190 | A1 * | 11/2012 | Halloran | E03D 11/16 29/428 |
| 2013/0205488 | A1 * | 8/2013 | Laundre | E03D 11/16 4/420 |
| 2015/0240468 | A1 * | 8/2015 | Zhou | E03D 11/16 4/252.1 |
| 2016/0076237 | A1 * | 3/2016 | Laundre | E03D 11/16 4/420 |
| 2019/0024357 | A1 * | 1/2019 | Halloran | E03D 11/16 |

FOREIGN PATENT DOCUMENTS

| | | |
|---|---|---|
| CN | 203782847 U | 8/2014 |
| TW | 356153 | 7/1987 |
| TW | M448518 U1 | 3/2013 |

* cited by examiner

*Primary Examiner* — Huyen D Le
(74) *Attorney, Agent, or Firm* — LANWAY IPR SERVICES; Chun-Ming Shih

(57) ABSTRACT

A mounting component for toilets is provided. The mounting component includes a first connection member, a seat, and a second connection member. The first connection member consists of a connection end and a fix end connected to a toilet flange. The seat is composed of a connection part and a main body inserted through a mounting slot on a bottom wall of the toilet. The main body is provided with an abutting portion against the floor and a connection hole arranged with respect to an operation hole of the toilet. The connection part is connected and fixed on the connection end of the first connection member. A connection end of the second connection member is inserted through the operation hole of the toilet and connected to the connection hole. The mounting component not only makes installation simple, fast and secure but also ensures overall aesthetics.

11 Claims, 8 Drawing Sheets

MOUNTING COMPONENT FOR TOILET

FIELD OF THE INVENTION

The present invention relates to aids and accessories for mounting toilets, especially to a mounting component for installing a one-piece toilet on a toilet flange.

BACKGROUND OF THE INVENTION

Generally, toilets are fixed by a wet installation or a dry installation. The wet installation has multiple shortcomings so that the dry installation is commonly used now. Refer to Taiwanese Pat. Pub. No. M356153, a fixing plate used for dry installation of the toilet is provided. First a fixing plate is mounted to a waste pipe on a floor. Then the floor is fixed by expansion bolts and the fixing plate is provided with bolts which are inserted through fixing holes on saddle-like area on left and right sides of the toilet to be threaded to nuts. Thereby the toilet is fixed on the fixing plate.

Refer to Taiwanese Pat. Pub. No. M448518, a device for fixing toilets is provided. The device improves the above fixing plate. Moreover, there are many other patent documents which provide a toilet flange or closet flange similar to the fixing plate mentioned above. For example, U.S. Pat. Nos. 8,281,421, 6,634,034, 6,065,160, and 5,421,036 all provide technical solutions for installing the toilet on the floor of buildings by dry installation.

According to the above technical documents, it can be understood clearly that these toilet flanges are applied to toilet plumbing for securing the toilet to the floor and connecting an outlet of the toilet to the waste pipe on the floor.

During installation, the above toilet flange is connected to the waste pipe by an axial pipe and also secured over the floor. A wax ring is filled into a gap between the toilet flange and a bottom of the toilet. A fixing hole is arranged at the saddle-like area on the left and the right sides of the toilet. The toilet is secured to the toilet flange by two bolts inserted through the fixing holes, instead of being directly secured to the floor.

However, a lot of one-piece toilets available now are not provided with the saddle-like area design for overall shape or aesthetic purposes. Thus the toilet is unable to be secured through the bolts on the toilet flange. A common way for securing the toilet is described below. The bolts connected to the toilet flange are mounted into installation slots on two sides of a bottom wall of the toilet first. Then each of the bolts is threaded to a nut pressed on an upper surface of the bottom wall for fastening and tightening. The shortcoming of such design is in that the nuts should be mounted into the toilet through the installation holes on two vertical walls at two lateral sides of the toilet for fastening while installing the nuts. In consideration of structural strength and aesthetics of the vertical walls of the toilet, shapes and sizes of the installation holes have certain limitations. Users often can use only two fingers such as thumb and index finger to install the bolts and the nuts so that assembly process is quite difficult and the bolts and the nuts are not tightened. After being used for a period of time, bolts and the nuts are easy to loosen.

Furthermore, other accessories can also be used for securing the toilet. For example, two L-shaped brackets are used and a horizontal portion on the bottom of the L-shaped bracket is secured to the bolts on two sides of the toilet flange in advance. Then a vertical portion of the L-shaped bracket is provided with a plurality of securing holes. Thus installers insert the bolts on the two sides of the toilet flange through corresponding insertion holes on two vertical walls of the toilet and then insert the bolts into corresponding securing holes on the L-shaped brackets for securing the toilet to the toilet flange. Please refer to Chinese Utility Model Pat. No. CN203782847U, a mounting component for one-piece toilets is provided. The mounting component is the L-shaped bracket for installation and securing.

Although tools such as a slotted or Phillips screwdriver can be used to insert and connect the bolt to the L-shaped bracket by thread engagement instead of manual operation, the use of L-shaped bracket still has certain shortcomings. For example, during threading and tightening process, a joint between the horizontal portion and the vertical portion of the L-shaped bracket is easy to have flexible deformation under influence of external force. After a period of time, the joint is easy to lose its fastness due to elastic fatigue. Thus the toilet may come loose. Moreover, the vertical portion of the L-shaped bracket is provided with the plurality of securing holes. Yet the insertion holes on the vertical walls of the toilet are quite small. Together with the fact that there is still a distance between the vertical portion of the bracket and a vertical wall, installers area unable to thread the bolt with the assistance of eyes. They can only look for suitable securing holes by their operating feelings. Thus the installers usually need to try multiple times to find the suitable securing holes. The installation is not easy. If the fastening is performed without finding the suitable securing hole, pseudo fastening may occur and further cause loosening or shaking later.

SUMMARY

Therefore, it is a primary object of the present invention to provide a mounting component for toilets not only ensuring installation of the toilet is easy and convenient but also allowing the toilet to be fastened on a toilet flange and the floor stably and firmly. Thus loosening or shaking of the toilet will not occur while in use.

The mounting component includes a first connection member, a seat, and a second connection member.

The first connection member is provided with a connection end and a fix end connected to the toilet flange.

The seat consists of a connection part and a main body with an upper end inserted through a mounting slot on a bottom wall of the toilet. The main body is provided with an abutting portion abutting against the floor and a connection hole arranged with respect to an operation hole of the toilet. The connection part is connected and fixed on the connection end of the first connection member.

The second connection member includes a connection end inserted through the operation hole of the toilet and connected to the connection hole.

The present mounting component for one-piece toilets has the following advantages.

Firstly, the seat of the above mounting component can be installed on the toilet flange in advance. During installation, the respective mounting slots on the bottom of the toilet are aligned with and mounted to the seats corresponding to the mounting component. Then a second bolt is directly inserted though the operation hole of the toilet or a guiding sleeve pre-installed at the operation hole to be guided and aligned with a threaded hole inside the respective seats smoothly. Next installers only need to use common tools such as slotted or Phillips screwdriver to operate and rotate the respective second bolts for fastening the second bolts with the threaded holes of the seats by thread engagement quickly and smoothly. Thereby the toilet is pressed and fastened onto the floor easily. The whole installation is quite easy and fast.

The operation hole only needs to be designed to allow the second bolt or the long guiding sleeve to insert. Thus the operation hole can be designed to have a smaller hole size. Thereby aesthetic appeal and structure strength of a vertical wall of the toilet are ensured.

After being installed, the seat keeps abutting against an inner side of the toilet. The second bolt fastened to the seat can also apply a downward force to the toilet effectively. Thus the bottom wall of the toilet is forced to press against the corresponding floor tightly. The toilet is installed firmly, without shaking or loosening.

BRIEF DESCRIPTION OF THE DRAWINGS

In order to learn techniques in the embodiments more clearly, the figures used in description of the embodiments and technique available now are briefly described below. It is obvious that the figures described below are only related to some embodiments of the present invention. For people skilled in the art, they can obtain other figures based on these figures without creative work.

DETAILED DESCRIPTION

In order to learn technical content, features, and functions of the present invention more clearly and completely, please refer to the following embodiments with related figures and reference signs. The following embodiments are used to explain the present invention, not intended to limit the present invention.

Figure 1:
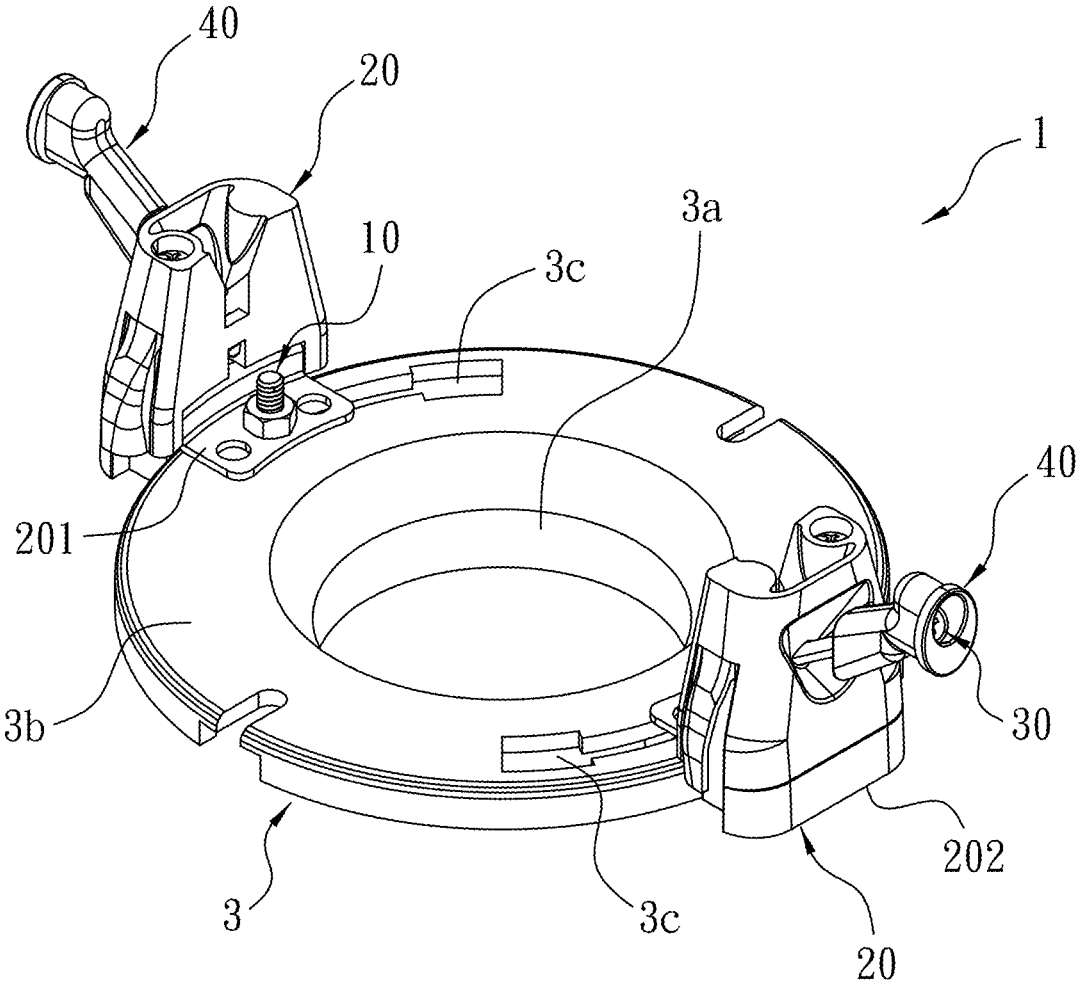
FIG. 1 is a perspective view of a first embodiment of a mounting component assembled with a toilet flange according to the present invention.
Figure 5:
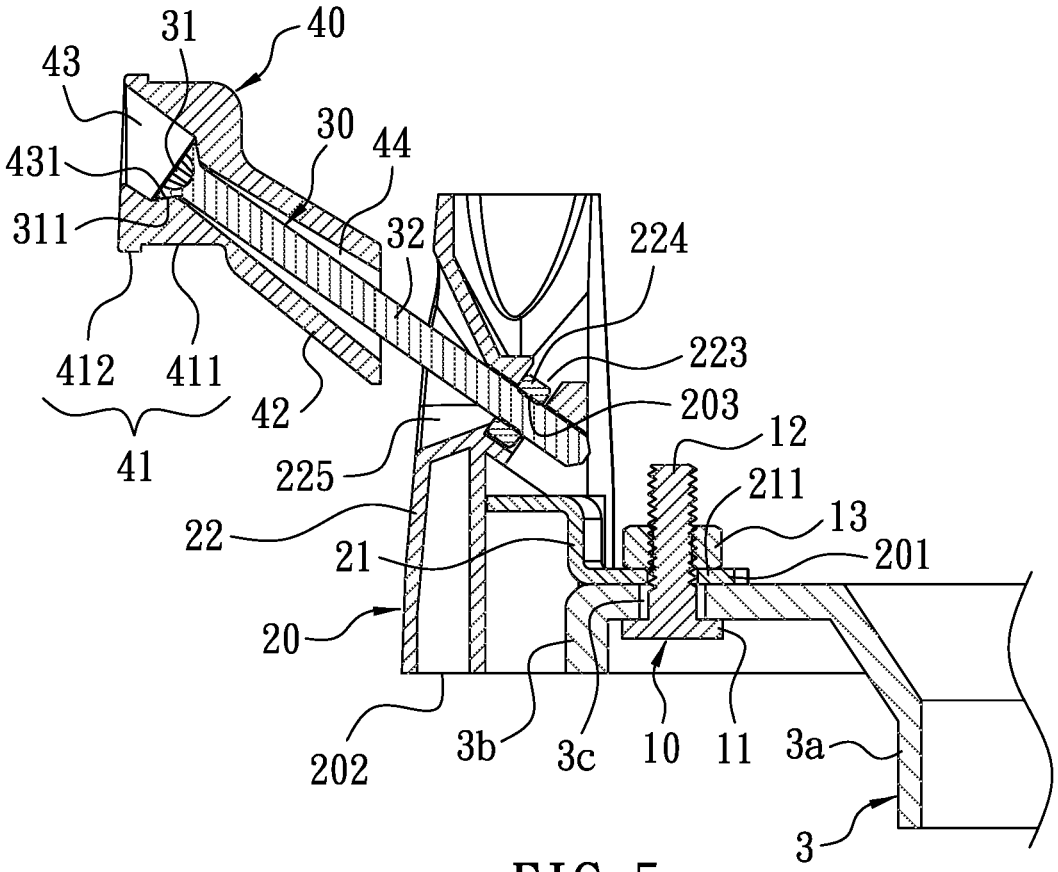
FIG. 5 is a partial enlarged view of a left side of the embodiment in FIG. 4 according to the present invention.
Figure 7:
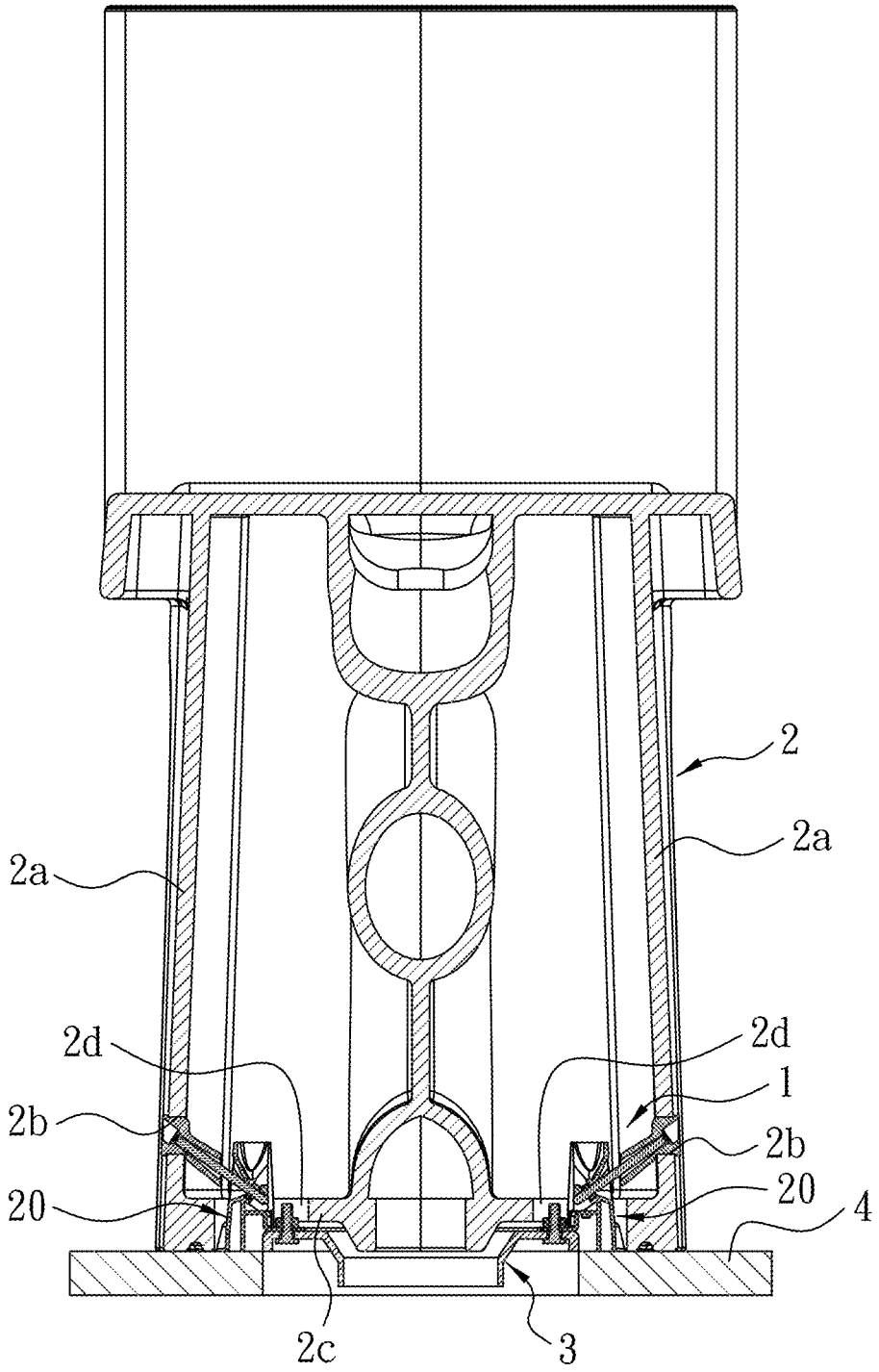
FIG. 7 is a partial longitudinal sectional view of a first embodiment of a mounting component installed on a toilet flange and a toilet mounted on the mounting component and a floor according to the present invention.
Figure 8:
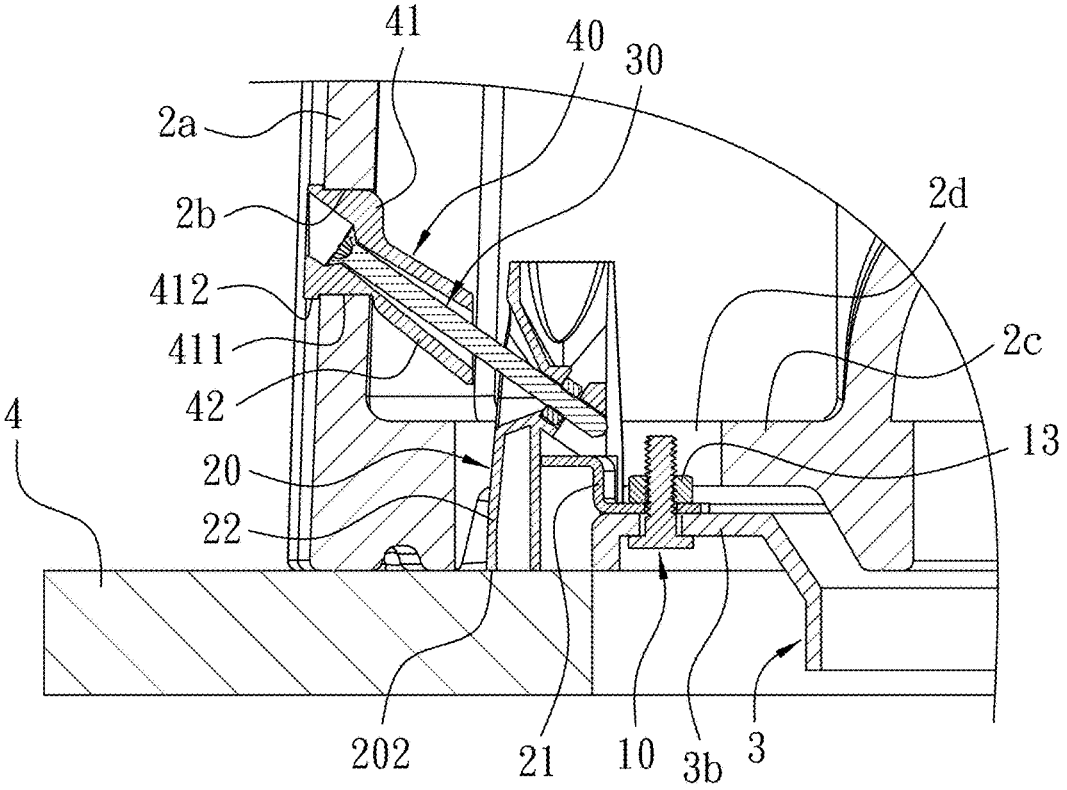
FIG. 8 is a partial enlarged view of a lower left side of the embodiment in FIG. 7 according to the present invention.

Embodiment 1: refer to FIG. 1, FIG. 7, and FIG. 8, a first embodiment of a mounting member 1 for one-piece toilets 2 is provided. While in use, the toilet 2 is installed and fixed on a toilet flange 3 by the mounting member 1. The toilet 2 has the following structure. A vertical wall 2*a* is formed on each of two sides of the toilet 2 and provided with an operation hole 2*b*. A bottom wall 2*c* is disposed on a bottom of the toilet 2 and a mounting slot 2*d* is penetrating each of two sides of the bottom wall 2*c*. As shown in FIG. 5, the toilet flange 3 includes a pipe 3*a* in a middle part, a circular projecting rim 3*b* on a top of the pipe 3*a*, and two curved grooves 3*c* symmetrically arranged at the circular projecting rim 3*b*. The toilet flange 3 is installed and fixed on a floor 4 of a building by the circular projecting rim 3*b*.

In this embodiment, refer to FIGS. 1-4, the mounting member 1 for the toilet 2 consists of a first connection member 10, a seat 20, and a second connection member 30.

The first connection member 10 is provided with a fix end 11 connected to the toilet flange 3 and a connection end 12.

The seat 20 is composed of a main body 22 and a connection part 201. The main body 22 has an upper end inserted through the mounting slot 2*d* on the bottom wall 2*c* and the connection part 201 is connected and fixed on the connection end 12 of the first connection member 10, as shown in FIG. 5 and FIG. 7. The main body 22 is provided with an abutting portion 202 abutting against floor 4 and a connection hole 203 arranged with respect to the operation hole 2*b* of the toilet 2.

A connection end of the second connection member 30 is inserted through the operation hole 2*b* of the toilet 2 and connected to the connection hole 203.

While in use, the abutting portion 202 is abutting against the floor 4. The upper end of the main body 22 is inserted through the mounting slot 2*d* arranged at each of two opposite positions of the toilet 2. The connection hole 203 is disposed with respect to the operation hole 2*b* of the toilet 2 at a preset angle. The connection end of the second connection member 30 is inserted through the operation hole 2*b* of the toilet 2 and connected to the connection hole 203 for pressing and fixing the toilet 2 on a corresponding upper surface of the floor 4 around the toilet flange 3.

In a preferred embodiment, the first connection member 10 is a first bolt whose head (fix end 11) is installed in the curved grooves 3*c* of the toilet flange 3. A shaft of the first bolt (the connection end 12) is connected to fastened by the connection part 201 of the seat 20. The first connection member 10 can also be in other structure such as threaded rod. The toilet flange 3 is provided with an installation hole mated with the threaded rod. A lower end of the threaded rod is fastened on the toilet flange 3 by a nut and an upper end of the threaded rod is also fastened on the connection part 201 by another nut. Rivets can also be used.

The second connection member 30 can be a second bolt and the connection hole 203 of the seat 20 is a threaded hole. A shaft of the second bolt is inserted through the operation hole 2*b* of the toilet 2 and connected to the threaded hole on the seat 20. During arrangement, the operation hole 2*b* and the threaded hole are tilted and the second bolt is used to fasten the vertical wall 2*a* of the toilet 2 with the seat 20. The second connection member 30 can also be a connection rod with a locking end on each of two ends. The two ends of the connection rod are connected to and locked at the operation hole 2*b* of the toilet 2 and the connection hole 203 of the seat 20 correspondingly.

While fixing the toilet 2 on the toilet flange 3, two sides of the toilet flange 3 are connected to the seats 20 by the first connection members 10. Two sides of the toilet 2 are also connected to the corresponding seats 20 by the second connection members 30. By fixing and connection on the two sides, the toilet 2 and the toilet flange 3 are connected and fixed. While in use, loosening or shaking of the toilet 2 will not occur. Under certain conditions, the circular projecting rim 3*b* of the toilet flange 3 is provided with at least three curved grooves 3*c* and the vertical wall 2*a* of the toilet 2 is provided with at least three corresponding operation holes 2*b*. Each of the curved grooves 3*c* of the toilet flange 3 is connected to one first connection member 10 and the operation hole 2*b* is connected to one second connection member 30. The seat 20 is connected to and located between the first connection member 10 and the second connection member 30 correspondingly.

In this embodiment, the connection part 201 of the seat 20 is provided with at least one insertion hole 204. The fix end 11 of the first connection member 10 is provided with a locking head mated to the groove 3*c* of the toilet flange 3. An end portion of the connection end 12 is inserted through the insertion hole 204 and connected to a limit unit 13.

To be more specific, a bolt head (locking head) of the first bolt can be locked and limited in the groove 3*c* of the toilet flange 3 while an end of a shaft of the first bolt is inserted through the insertion hole 204 and connected to a nut (the limit unit 13). Thereby the toilet flange 3 and the connection part 201 of the seat 20 are fastened, connected, or fixed. When the first connection member 10 is in a structure other than the bolt, the limit unit 13 can be magnets, laterally-arranged bolt, etc.

Figure 2:
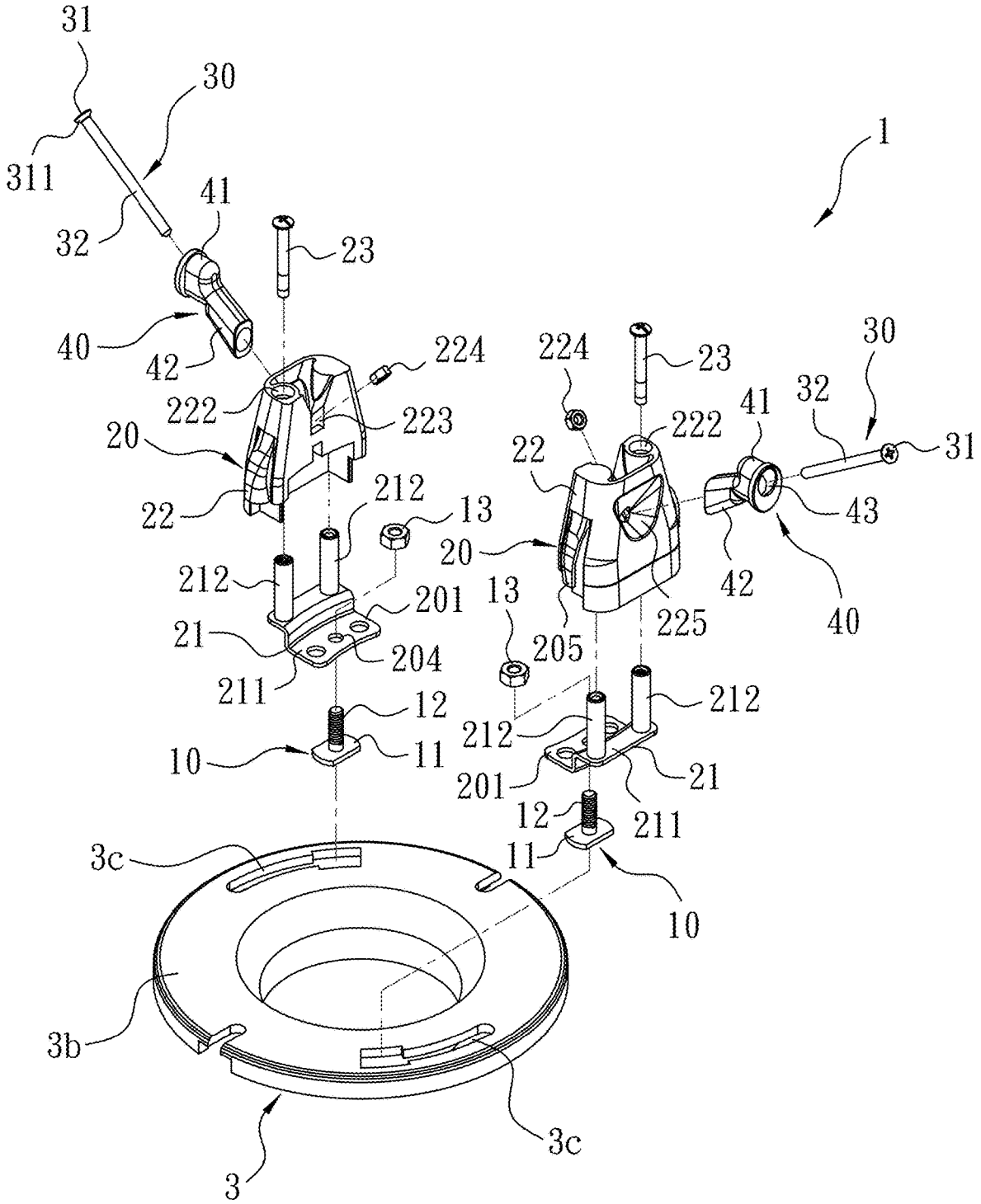
FIG. 2 is an exploded view of a first embodiment of a mounting component separated from a toilet flange according to the present invention.
Figure 3:
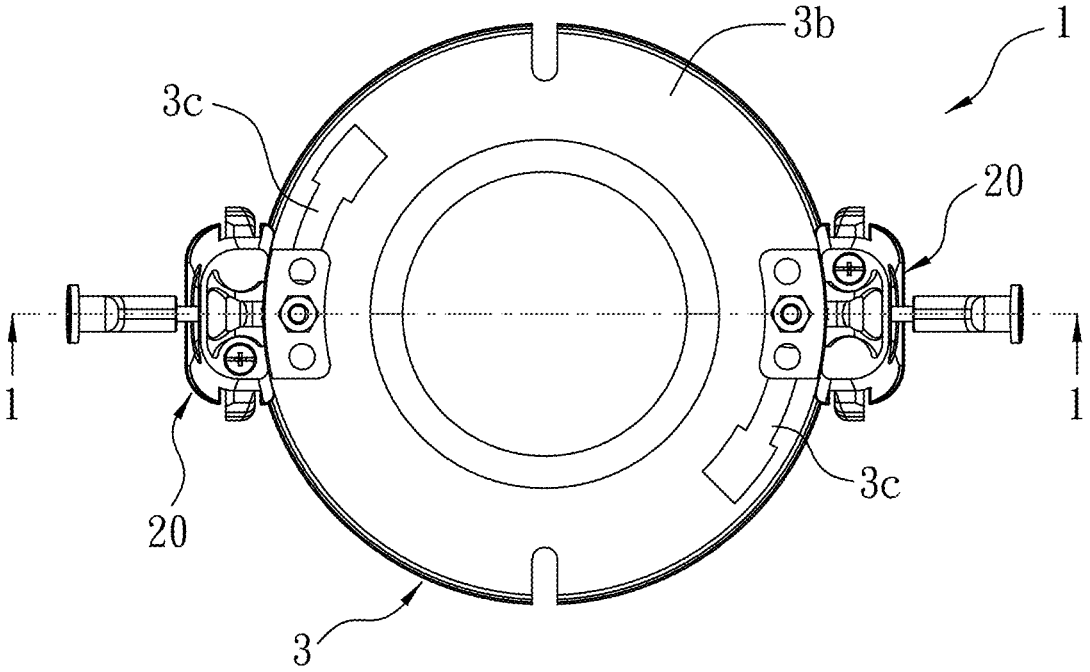
FIG. 3 is a top plane view of the embodiment in FIG. 1 according to the present invention.
Figure 4:
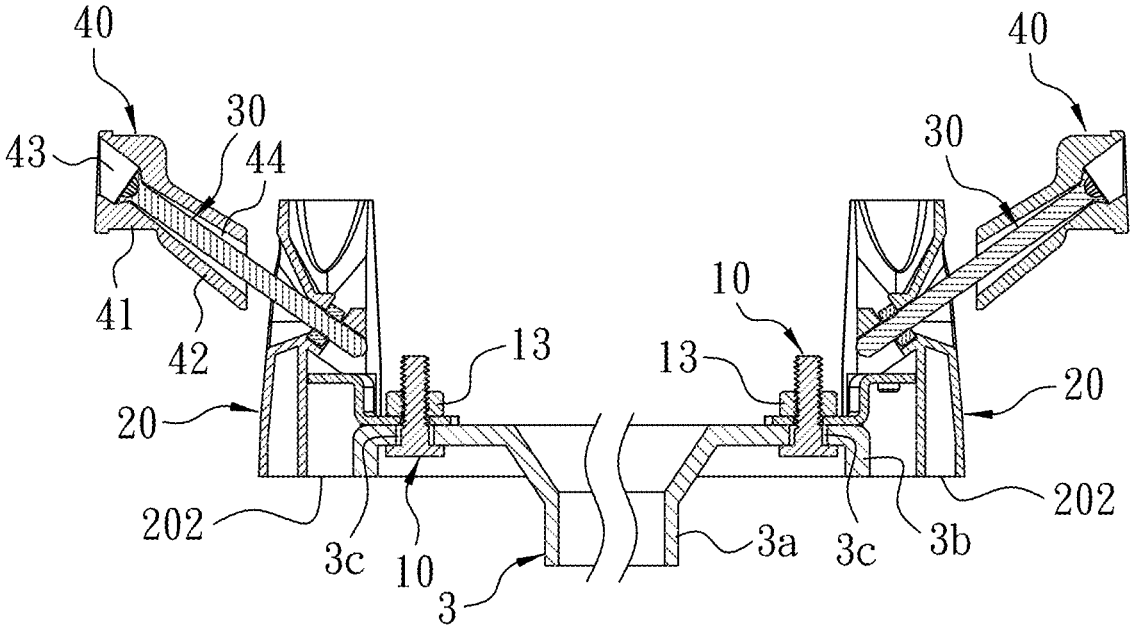
FIG. 4 is a sectional view of the embodiment in FIG. 3 along line 1-1 according to the present invention.

As shown in FIG. 2, the seat 20 further includes a connection pad 21 and a third connection member 23. The connection pad 21 is provided with a connection plate 211 and two positioning-adjustment portions 212 extended vertically from the connection plate 211. The connection part 201 is formed on the connection plate 211. The main body 22 includes a positioning groove 221 having an opening facing downward and a through hole 222 communicating with a top of the positioning groove 221. The positioning-adjustment portion 212 is inserted into and moved with respect to the positioning groove 221. That means the positioning groove 221 allows the positioning-adjustment portion 212 to slide upward and position therein. The third connection member 23 is inserted into the through hole 222 through a top of the through hole 222 and connected to the positioning-adjustment portion 212. The third connection member 23 and the positioning-adjustment portion 212 can be connected by snap-fit, interference fit, suction connection, etc. In this embodiment, the third connection member 23 can be a third bolt. The positioning-adjustment portion 212 is in a tubular structure and provided with an inner thread. The third bolt is inserted through the through hole 222 from a top of the main body 22 to be connected to the positioning-adjustment portion 212 by threaded engagement. As a modified embodiment, the positioning-adjustment portion 212 is provided with an outer thread and a tube opening is mounted to a lower end of the third connection member 23 and provided with an inner thread. Thus the third connection member 23 and the positioning-adjustment portion 212 are connected by threaded connection.

Moreover, the third connection member 23 can be a connection rod which is inserted into the positioning-adjustment portion 212 and connected by interference fit or mating connection. The third connection member 23 is used to adjust positions of the positioning-adjustment portion 212 and positions of the connection pad 21 with respect to the main body 22. At the same time, the main bod 22 is connected to the toilet 2 by the second connection member 30 and thus the abutting portion 202 of the main body 22 is forced to be abutting against and pressed on the floor 4 firmly.

It should be noted that the main body 22 in this embodiment includes the two positioning grooves 221. The number of the positioning groove 221 is not limited, able to be 1, 2, 3, 4, etc. The number of the positioning groove 221 is determined according to actual conditions. Similarly, the connection pad 21 in this embodiment is provided with a plurality of the positioning-adjustment portions 212 each of which is sliding and positioned in the positioning grooves 221 correspondingly. Thus smoothness of the sliding and mounting process is ensured. Yet the firmness of the fastening can still be ensured by only one of the positioning grooves 221 combined with a third bolt.

In this embodiment, as shown in FIG. 5, the main body 22 is provided with a locking slot 223 in which a fourth connection member 224 is mounted. The fourth connection member 224 is limited in the locking slot 223, unable to be rotated with respect to the locking slot 223. The connection hole 203 is disposed on the fourth connection member 224.

The fourth connection member 224 can be a nut which is detachably mounted in the locking slot 223 of the main body, but not limited. The nut can also be directly pre-embedded inside the main body 22 and the connection hole 203 is a threaded hole.

In this embodiment, as shown in FIG. 2 and FIG. 5, the mounting member 1 further includes a guiding sleeve 40 which is provided with a positioning head 41, a guidance portion 42 extended obliquely from the positioning head 41, a head positioning slot 43 recessed from one side of the positioning head 41, and a guiding hole 44 formed inside the guidance portion 42 and communicating with the head positioning slot 43. The second connection member 30 consists of a limit head 31 and a connection rod portion 32 connected to the limit head 31. The connection rod portion 32 is inserted through the head positioning slot 43 and the guiding hole 44 to be connected to the connection hole 203. The limit head 31 is stopped and limited in the head positioning slot 43. An outer end of the connection rod portion 32 is the connection end of the above-mentioned second connection member 30.

Also refer to FIG. 5 and FIG. 7, the guidance portion 42 is inserted through the corresponding operation hole 2*b* from an outer side into an inner side of the vertical wall 2*a* of the toilet 2 and the positioning head 41 is mounted and positioned in the corresponding operation hole 2*b*. When the connection rod portion 32 is inserted into the connection hole 203, the connection rod portion 32 is inserted through the head positioning slot 43 and under guidance of the guiding hole 44 of the guiding sleeve 40 to be aligned and connected to the connection hole 203 of the seat 20.

It is easy to understand that the guiding sleeve 40 in this embodiment not only works as a lining, like gaskets, but also for guiding the second connection member 30 to be aligned with the connection hole 203 accurately and quickly. The second connection member 30 can be a second bolt and the connection hole 203 of the seat 20 is a threaded hole.

As shown in FIG. 5 and FIG. 8, the positioning head 41 of the guiding sleeve 40 further includes an insertion and mounting portion 411 and a stopping edge 412 extending from a side of an outer end of the insertion and mounting portion 411.

The insertion and mounting portion 411 is used for being mounted and positioned in the operation hole 2*b* of the toilet 2 while the stopping edge 412 is stopped and limited by the vertical wall 2*a* of the toilet 2 and located at an outer wall surface around the operation hole 2*b*.

In this embodiment, an inner conical wall 431 is formed on the head positioning slot 43 of the guiding sleeve 40 and an outer conical wall 311 is formed on the limit head 31 of the second connection member 30 for abutting against the inner conical wall 431. Thus it is ensured that the limit head 31 is tightly-pressed and positioned in the head positioning slot 43 stably and firmly.

In this embodiment, an outer surface of the seat 20 corresponding to the guiding sleeve 40 is provided with a tapered guiding chute 225 arranged concavely. The guiding chute 225 is communicating with the connection hole 203 and used for guiding a rear end of the connection rod portion 32 of the second connection member 30 to slide into the connection hole 203 and connect to the connection hole 203. That means the guiding chute 225 is used for guiding a rear end of the shaft of the second bolt to slide to the threaded hole to be fastened by threaded engagement.

In this embodiment, a diameter of the guiding hole 44 is gradually increased from one end of the guiding hole 44 connected to the head positioning slot 43 toward a distal end (the other end) of the guiding hole 44. That means the diameter is getting larger. The above design allows the connection rod portion 32 of the second connection member 30 able to be swung and moved a little bit after being inserted through the guiding hole 44. Thus it is ensured that the connection rod portion 32 can be guided and slid to the connection hole 203 smoothly for connection with the connection hole 203. This means the above design allows a larger assembly tolerance and thus assembly failure will not occur or difficulty in assembly can be eliminated.

Figure 6:
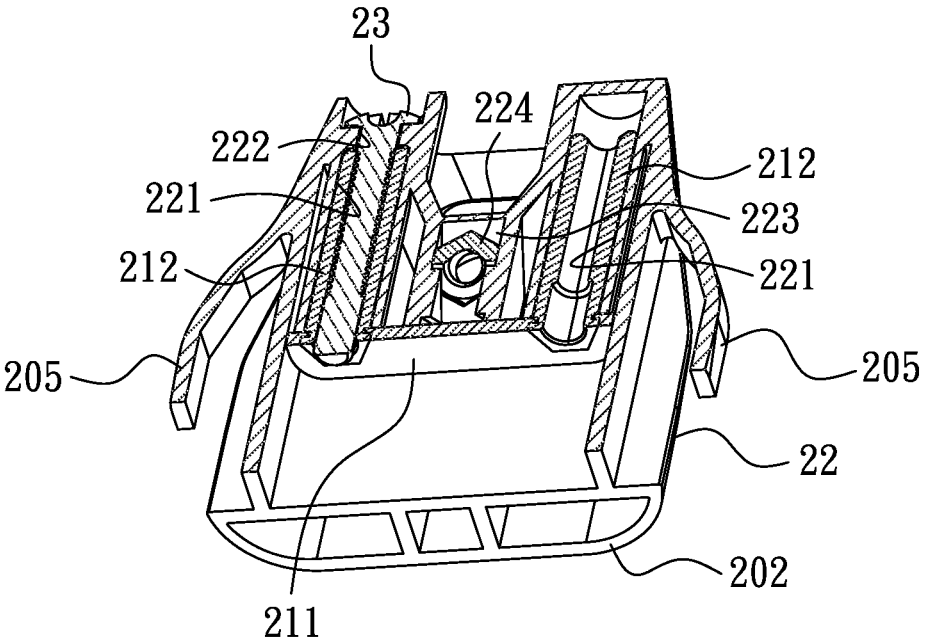
FIG. 6 is a perspective sectional view of a first embodiment along two positioning-adjustment portions of a connection plate according to the present invention.

In this embodiment, as shown in FIG. 2 and FIG. 6, an elastic wing 205 is disposed on each of two opposite sides of the seat 20.

Each of the two opposite sides of the seat 20 is provided with one elastic wing 205. Thereby while assembling the main body 22, the seat 20 is initially fixed by the elastic wings 205 elastically pressing against two opposite inner wall surfaces of the opposite mounting slots 2*d* on the bottom wall 2*c* of the toilet 2. This helps the following assembly and operations. The possible problems of dimensional tolerance existed between the main body 22 and the mounting slot 2*d* can also be solved. During assembly, the elastic wing 205 can be a parabola and an upper end of the elastic wing 205 is connected to a lateral side of the seat 20 while a middle-and-lower end of the elastic wing 205 is suspended in the air so that a certain elasticity is provided.

It should be pointed out that an upper surface of the circular projecting rim 3*b* of the toilet flange 3 is at a higher level than an upper surface of the floor 4, as shown in FIG. 8. Yet in actual installation and construction, some toilet flanges 3 are installed at different levels according to different on-site conditions. For example, they are disposed on the same level. Moreover, the upper surface of the floor 4 is arranged with decorative surface materials, such as tiles, with different heights. In this embodiment, by the positioning-adjustment portions 212 of the connection pad 21 able to be sliding and adjusted in the positioning grooves 221 of the main body 22 vertically and flexibly, the abutting portion 202 of the main body 22 can be abutting against the floor 4 firmly, without being affected by the level of the toilet flange 3. Thereby flexibility and firmness is provided during the installation.

Figure 9:
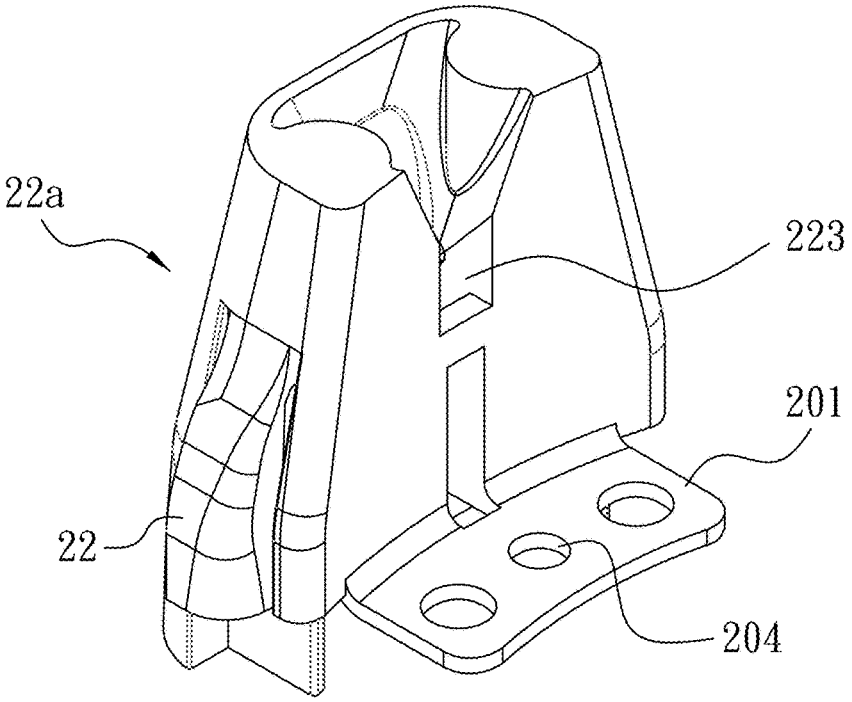
FIG. 9 is a perspective view of another embodiment (second embodiment) of a mounting component according to the present invention.
Figure 10:
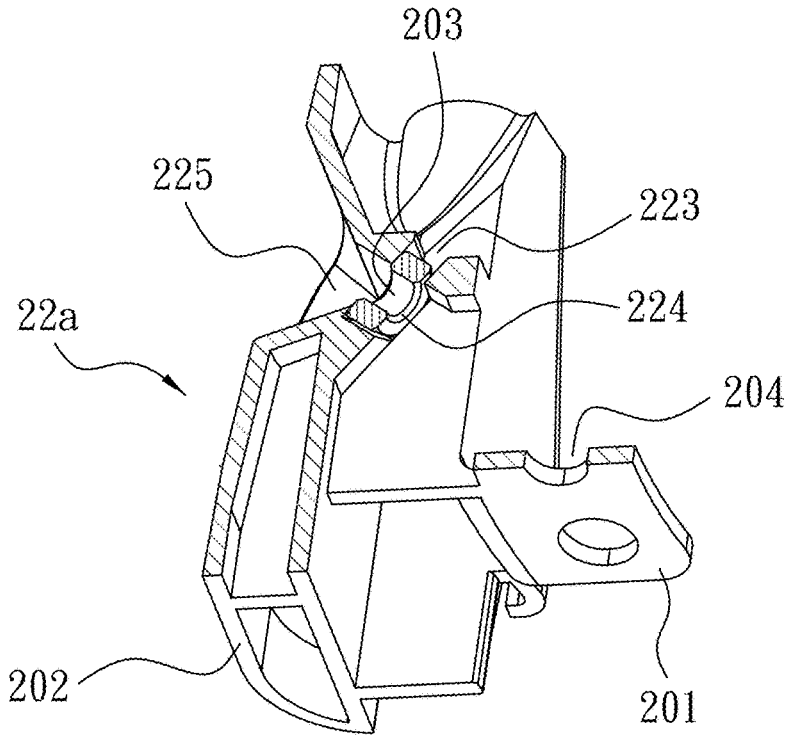
FIG. 10 is a perspective sectional view of a main body of the embodiment in FIG. 9 according to the present invention.

Embodiment 2: as shown in FIG. 9 and FIG. 10, another embodiment of a mounting member 1 for one-piece toilets 2 is provided. The mounting member 1 in this embodiment is about the same as the above embodiment and the only difference is in that the main body 22 and the connection pad 21 of the seat 20 in the first embodiment are integrated into one part of the seat 20 in this embodiment. Owing to integration of the two parts, the parts and assembly related such as the positioning-adjustment portion 212, the positioning groove 221, the through hole 222, and the third connection member 23 are not provided. Thus the structure of the seat 20 is simplified. In other words, the connection part 201 is integrally formed on a main body 22*a* of the seat 20 in this embodiment.

The seat 20 consists of the main body 22*a* and the fourth connection member 224. The main body 22*a* forms the main part of the seat 20 while the connection part 201, the abutting portion 202, and the locking slot 223 are integrally formed on the main body 22*a*. The fourth connection member 224 is mounted and positioned in the locking slot 223 with limited rotation to form the connection hole 203 of the seat 20. The fourth connection member 224 can be a nut and the connection hole 203 can be a threaded hole.

In this embodiment, the structure is simplified due to the connection part 201 integrally formed on the main body 22*a* and this is beneficial to manufacturing. Yet the mounting member 1 of this embodiment is unable to be adjusted freely according to the level of the on-site toilet flange 3 being installed. Thus the mounting member 1 of this embodiment is usually used in combination with the toilet flange 3 installed at the specific level, the floor 4 at a specific level, or the floor 4 provided with decorative surface materials having a specific height over the floor 4.

Figure 11:
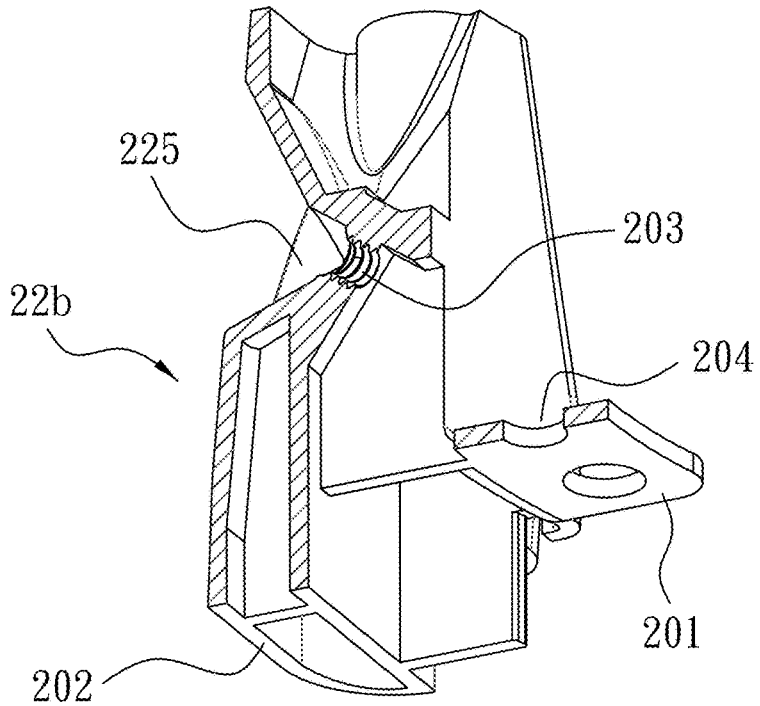
FIG. 11 is a perspective sectional view of a main body of a third embodiment according to the present invention.
Figure 12:
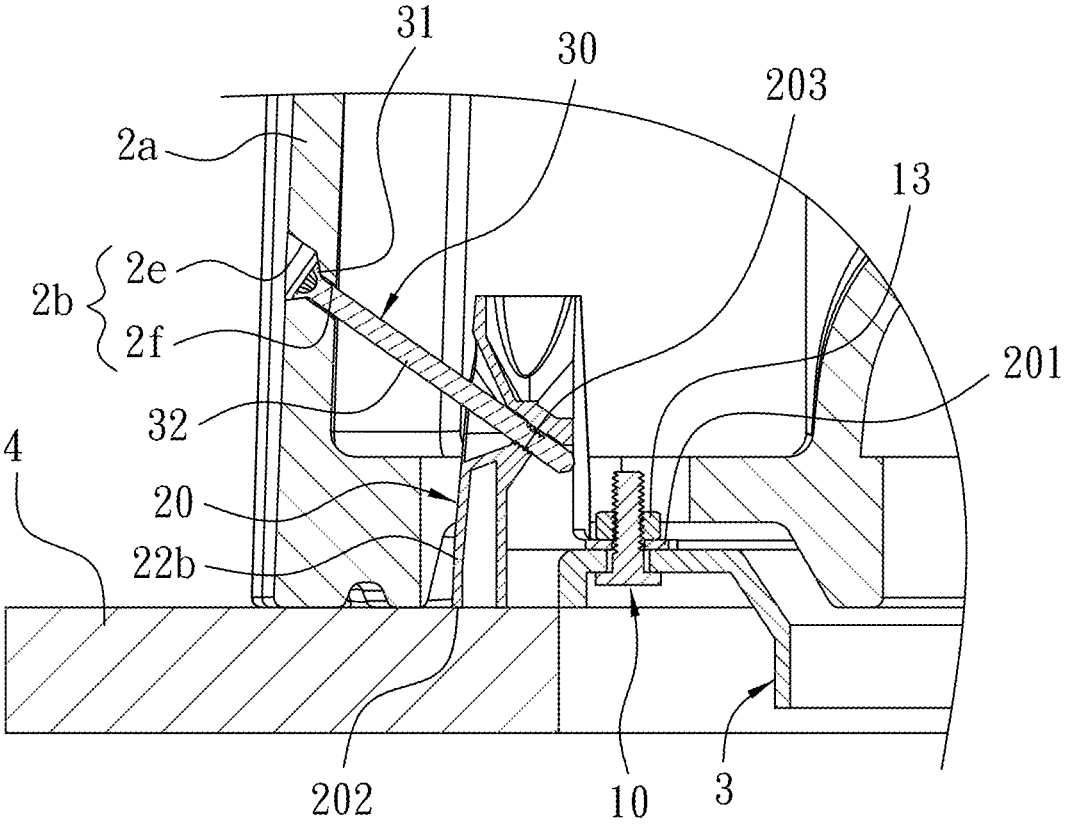
FIG. 12 is a partial longitudinal sectional view of a third embodiment of a mounting component installed on a toilet flange and a toilet mounted on the mounting component and a floor according to the present invention.

Embodiment 3: as shown in FIG. 11 and FIG. 12, a further embodiment of a mounting member 1 for one-piece toilets 2 is provided. The mounting member 1 in this embodiment is about the same as the above embodiment and the only difference is in that the connection hole 203 is integrally formed inside a main body 22*b* in this embodiment. Thus there is no locking slot 223 and no fourth connection member 224 provided in this embodiment.)

Moreover, a component similar to the head positioning slot 43 of the guiding sleeve 40 of the above two embodiments is directly formed in the operation hole 2*b* on the respective vertical walls 2*a* of the toilet 2 for allowing the connection rod portion 32 of the second connection member 30 to insert through. Thereby the limit head 31 of the second connection member 30 is directly locked and limited in the operation hole 2*b*.

The connection part 201, the abutting portion 202, and the connection hole 203 are integrally formed on the seat 20. The second connection member 30 consists of the limit head 31 and the connection rod portion 32 connected to the limit head 31. The connection rod portion 32 is inserted through the operation hole 2*b* of the toilet 2 and a through hole 2*f* on the toilet 2 to be connected to the connection hole 203.

The respective operation holes 2*b* of the toilet 2 are provided with a head positioning slot 2*e* and the through hole 2*f* communicating with the head positioning slot 2*e* in a slanting manner. The connection rod portion 32 of the second connection member 30 is inserted through the head positioning slot 2*e* and the through hole 2*f* to be aligned and connected to the connection hole 203 of the seat 20. The limit head 31 is limited within the head positioning slot 2*e*.

Furthermore, in order to make the connection rod portion 32 accurately insert into and align with the connection hole 203, an outer surface of the seat 20 corresponding to the second connection member 30 is provided with a tapered guiding chute 225 arranged concavely. The guiding chute 225 is communicating with the connection hole 203 and used for allowing the rear end of the connection rod portion 32 of the second connection member 30 to slide into the connection hole 203 and connect to the connection hole 203.

The advantage of this embodiment is in that the mounting member 1 is not necessary to be used together with the guiding sleeve 40 in the first and the second embodiments. Yet the mounting member 1 is used in combination with specific toilets 2 which are provided with the operation holes 2*b*.

According to the above embodiments, the mounting member 1 for one-piece toilets 2 according to the present invention has the following advantages.

Firstly, the seats 20 of the above mounting member 1 can be installed on the toilet flange 3 in advance. During installation, the respective the mounting slots 2*d* on the bottom of the toilet 2 are aligned with and mounted to the seats 20 corresponding to the mounting member 1. Then the second bolt is directly inserted though the operation hole 2*b* of the toilet 2 or the guiding sleeve 40 pre-installed at the operation hole 2*b* to be guided and aligned with the threaded hole inside the respective seats 20 smoothly. Next installers only need to use common tools such as slotted or Phillips screwdriver to operate and rotate the respective second bolts for fastening the second bolts with the threaded holes of the seats 20 by thread engagement quickly and smoothly. Thereby the toilet 2 is pressed and fastened onto the floor 4 easily. The whole installation is quite easy and fast.

The operation hole 2*b* only needs to be designed to allow the second bolt or the long guiding sleeve 40 to insert. Thus the operation hole 2*b* can be designed to have a smaller hole size. Thereby aesthetic appeal and structure strength of the vertical wall 2*a* of the toilet 2 are ensured.

After being installed, the seat 20 keeps abutting against the inner side of the toilet 2. The second bolt fastened to the seat 20 can also applied a downward force to the toilet 2 effectively. Thus the bottom wall 2*c* of the toilet 2 is forced to press against the corresponding floor 4 tightly. The installation firmness of the toilet 2 is ensured and loosening or shaking of the toilet 2 can be avoided effectively.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

The invention claimed is:

1. A mounting component for toilets comprising:

a first connection member provided with a connection end and a fix end connected to the toilet flange;

a seat having a connection part and a main body with an upper end inserted through a mounting slot on a bottom wall of the toilet; the main body provided with an abutting portion abutting against a floor and a connection hole arranged with respect to an operation hole of the toilet; the connection part connected and fixed on the connection end of the first connection member; and a second connection member with a connection end inserted through the operation hole of the toilet and connected to the connection hole;

wherein the connection part of the seat is provided with an insertion hole; the fix end of the first connection member is provided with a locking head mated to a groove of the toilet flange; the connection end of the first connection member is provided with a connection rod portion inserted through the insertion hole and connected to a limit unit used for limiting movement of the connection rod portion;

wherein the seat further includes a connection pad and a third connection member; the connection pad is provided with a connection plate and at least one positioning-adjustment portion extended vertically from the connection plate; the connection part is formed on the connection plate; the main body includes at least one positioning groove having an opening facing downward and at least one through hole communicating with a top of the positioning groove; the positioning-adjustment portion is inserted into and moved with respect to the positioning groove; the third connection member is inserted into the through hole through a top of the through hole and connected to the positioning-adjustment portion.

2. The mounting component as claimed in claim 1, wherein the main body is provided with a locking slot in which a fourth connection member is mounted;

the fourth connection member is limited in the locking slot; the connection hole is mounted to the fourth connection member.

3. A mounting component for toilets comprising:

a first connection member provided with a connection end and a fix end connected to the toilet flange;

a seat having a connection part and a main body with an upper end inserted through a mounting slot on a bottom wall of the toilet; the main body provided with an abutting portion abutting against a floor and a connection hole arranged with respect to an operation hole of the toilet; the connection part connected and fixed on the connection end of the first connection member; and a second connection member with a connection end inserted through the operation hole of the toilet and connected to the connection hole;

wherein the mounting component further includes a guiding sleeve which is provided with a positioning head, a guidance portion extended obliquely from the positioning head, a head positioning slot recessed from the positioning head, and a guiding hole formed inside the guidance portion and communicating with the head positioning slot; the second connection member includes a limit head and a connection rod portion connected to the limit head; the connection rod portion is inserted through the head positioning slot and the guiding hole to be connected to the connection hole; the limit head is stopped and limited in the head positioning slot.

4. The mounting component as claimed in claim 3, wherein the positioning head of the guiding sleeve further includes an insertion and mounting portion being mounted and positioned in the operation hole of the toilet; and a stopping edge extending from a side of an outer end of the insertion and mounting portion; the stopping edge is stopped and limited by a vertical wall of the toilet and located at an outer wall surface around the operation hole.

5. The mounting component as claimed in claim 3, wherein an inner conical wall is formed on the head positioning slot of the guiding sleeve and an outer conical wall is formed on the limit head of the second connection member for abutting against the inner conical wall.

6. The mounting component as claimed in claim 3, wherein an outer surface of the seat corresponding to the guiding sleeve is provided with a tapered guiding chute arranged concavely; the guiding chute is communicating with the connection hole and used for allowing the connection rod portion of the second connection member to slide into the connection hole and connect to the connection hole.

7. The mounting component as claimed in claim 3, wherein a diameter of the guiding hole is gradually increased from one end of the guiding hole connected to the head positioning slot toward a distal end of the guiding hole.

8. The mounting component as claimed in claim 3, wherein an elastic wing is disposed on each of two opposite sides of the seat.

9. A mounting component for toilets comprising:

a first connection member provided with a connection end and a fix end connected to the toilet flange;

a seat having a connection part and a main body with an upper end inserted through a mounting slot on a bottom wall of the toilet; the main body provided with an abutting portion abutting against a floor and a connection hole arranged with respect to an operation hole of the toilet; the connection part connected and fixed on the connection end of the first connection member; and a second connection member with a connection end inserted through the operation hole of the toilet and connected to the connection hole;

wherein the main body is provided with a locking slot in which a fourth connection member is mounted; the main body forms a main part of the seat while the connection part, the abutting portion, and the locking slot are integrally formed on the main body; the fourth connection member is limited in the locking slot and forming the connection hole.

10. The mounting component as claimed in claim 1, wherein an elastic wing is disposed on each of two opposite sides of the seat.

11. The mounting component as claimed in claim 9, wherein an elastic wing is disposed on each of two opposite sides of the seat.

* * * * *